US010381705B2

(12) United States Patent
Okamoto

(10) Patent No.: US 10,381,705 B2
(45) Date of Patent: Aug. 13, 2019

(54) RADIAL POWER COMBINER/DIVIDER USING DIELECTRICALLY LOADED WAVEGUIDES

(71) Applicant: MERCURY SYSTEMS, INC., Andover, MA (US)

(72) Inventor: Douglas Seiji Okamoto, San Carlos, CA (US)

(73) Assignee: Mercury Systems, Inc., Andover, MA (US)

( * ) Notice: Subject to any disclaimer, the term of this patent is extended or adjusted under 35 U.S.C. 154(b) by 43 days.

(21) Appl. No.: 15/625,368

(22) Filed: Jun. 16, 2017

(65) Prior Publication Data

US 2018/0366806 A1 Dec. 20, 2018

(51) Int. Cl.
*H01P 5/12* (2006.01)

(52) U.S. Cl.
CPC ..... *H01P 5/12* (2013.01)

(58) Field of Classification Search
CPC ..... H01P 5/00; H01P 5/12; H01P 5/16; H01P 5/181
USPC ..... 333/125–129
See application file for complete search history.

(56) References Cited

U.S. PATENT DOCUMENTS

2017/0338539 A1* 11/2017 Danderson ..... H01P 5/16

FOREIGN PATENT DOCUMENTS

CN 107196029 A 9/2017
CN 107732400 A 2/2018

OTHER PUBLICATIONS

GB Search Report, Application No. GB1808816.1, dated Oct. 11, 2018, 3 pages.

* cited by examiner

*Primary Examiner* — Robert J Pascal
*Assistant Examiner* — Kimberly E Glenn

(57) ABSTRACT

A power combiner/power divider has a disk shaped housing cavity and a housing of electrically conductive material, such as metal. A junction pin is positioned centrally in the power combiner/divider. Additional ports are positioned radially along the periphery of the disk shaped portion. Tapered waveguides may extend from the radially positioned ports to the centrally positioned junction pin. A hollow radial cavity provided in the cavity holds a dielectric insert that may have tapering extensions radiating from a central ring. The ring surrounds the centrally positioned port.

15 Claims, 7 Drawing Sheets

RADIAL POWER COMBINER/DIVIDER USING DIELECTRICALLY LOADED WAVEGUIDES

BACKGROUND OF THE INVENTION

Power combiners combine the power from multiple inputs into a single output. Conversely, power dividers divide the power from a single input into multiple outputs. Power combiners and dividers have found use in many applications. For example, power combiners are often used in microwave communications to receive inputs from multiple amplifiers and combine those inputs into a single output. Thus, multiple lower power cheaper amplifiers may be used rather than a single more expensive higher power amplifier.

One limitation with current power combiners/dividers relates to the size of such power combiners/dividers. Conventional power combiners/dividers generally are large devices, which are often both costly and difficult to deploy.

SUMMARY

In accordance with at least one aspect of the present invention, a radial power combiner includes an electrically conductive housing having a disk shaped cavity. Input ports for receiving inputs are positioned radially around the disk shaped cavity and have electrical connections to the housing. A junction rod is centrally positioned in the disk shaped cavity for combining the inputs received by the input party. The junction rod has electrical communication with the output port. The housing provides tapered waveguides extending from the input ports to the output port. A dielectric material is positioned in the disk shaped cavity concentrically around the output port The dielectric material has tapered extensions extending radially outward from a central portion. The dielectric material may be, for example, plastic, such as polytetrafluoroethylene.

In accordance with another aspect of the present invention, a radial power divider includes an electrically conductive housing having a disk shaped cavity. An input port is positioned on the housing for receiving an input. A junction rod is in the electrical communication with the output port and receives the input from the input port. Output ports are positioned radially around the disk shaped cavity for outputting outputs. The output ports have electrical connections to the housing. A dielectric material is positioned concentrically around the junction rod. The dielectric material has tapered extensions extending radially outward from a central portion surrounding the junction rod. The disk shaped cavity includes tapered waveguides extending from the input port to the respective output ports.

DETAILED DESCRIPTION OF THE INVENTION

Exemplary embodiments described herein relate to a power combiner/divider architecture that provides several benefits. The architecture described herein has a smaller size than conventional power dividers/combiners. In addition, the power combiner/divider is designed to provide appropriate impedance matching at the transitions from ports to transmission lines in a power combiner/divider. This results in reduced reflections and a high level of power transfer.

The exemplary embodiments described herein deploy one or more dielectric materials in a radial cavity provided within the power combiner/divider. The one or more dielectric materials help to perform appropriate impedance transformations to yield the appropriate impedance matching. The power combiner/divider also deploys other approaches to further help with such impedance transformations.

Figure 1:
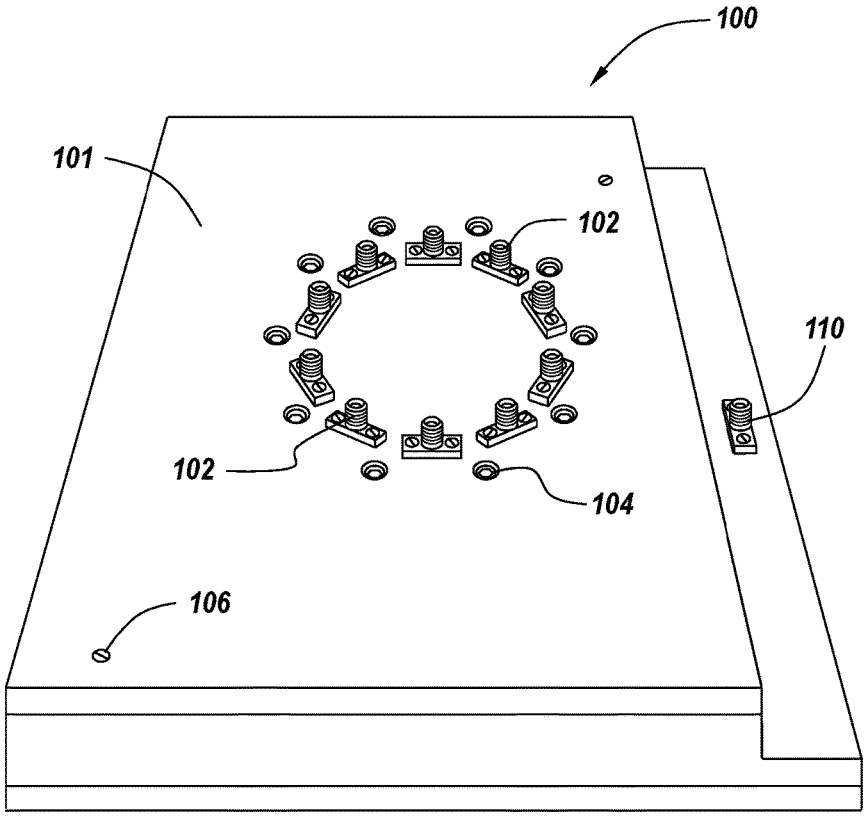
FIG. 1 depicts an illustrative power combiner/divider.

FIG. 1 shows a radial power combiner/divider 100 for an exemplary embodiment. For purposes of this discussion, we will initially discuss the device 100 as a power combiner. Nevertheless, as will be explained below, this architecture may be also deployed in a power divider. The device 100 includes a housing 101. Those skilled in the art will appreciate that the combiner may have numerous shapes such a rectangular shape, an oval shape or another suitable shape. The housing 101 is made of an electrically conductive material, such as a metal, like stainless steel.

The power combiner 100 includes input ports 102 that are uniformly spaced radially along the housing 101. These input ports 102 may be designed to receive coaxial inputs from an energy sources, such as microwave sources. The input ports 102 may include a configuration that is suitable for acting as a connector with a coaxial connector.

The housing 101 may include holes 104 for fasteners, such as screws for securing together components of the housing 101. Screws 106 may also be provided at more radially outward positions to secure together components.

The power combiner 100 includes a coaxial output port 110. As will be described in more detail below, the housing 101 provides waveguides that extend from the input ports 102 to a junction pin centrally located in a radial cavity.

Figure 2:
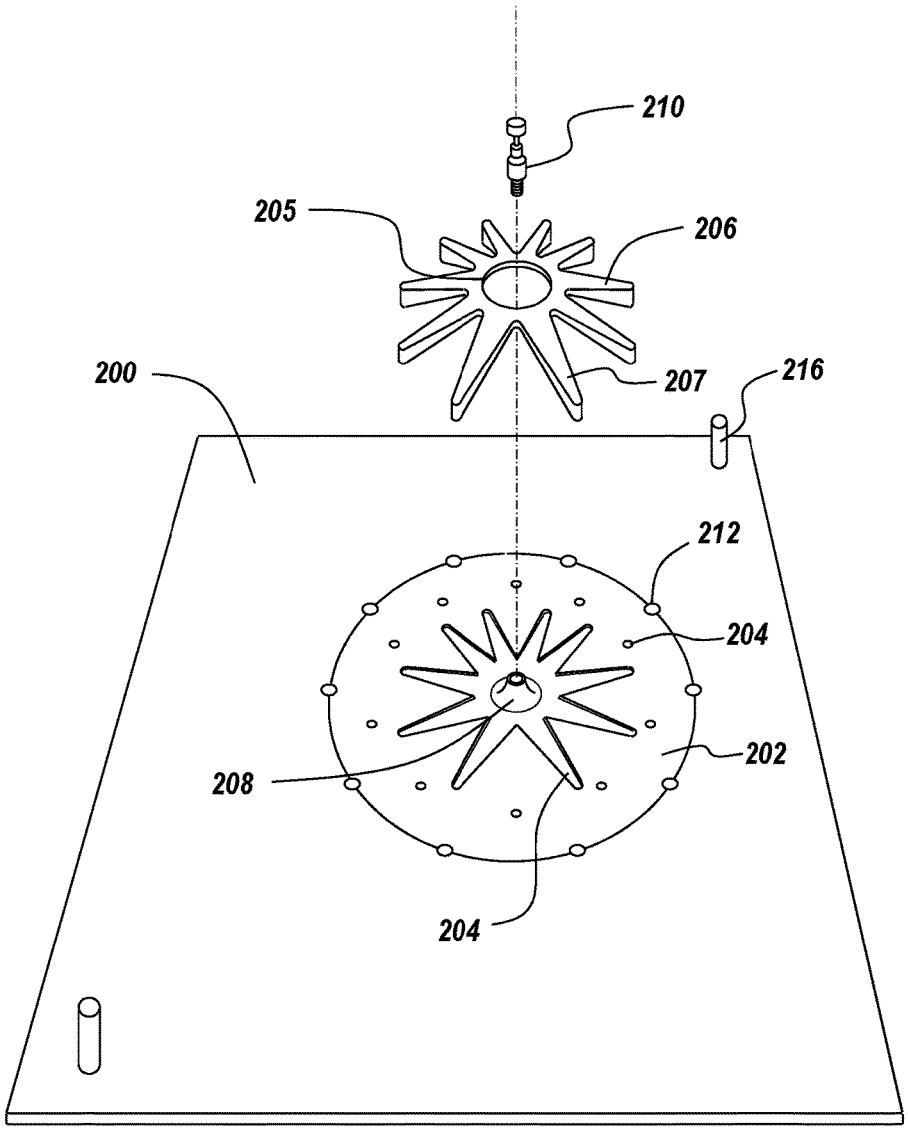
FIG. 2 depicts a top portion of a power combiner with a dielectric insert and a junction pin.
Figure 3:
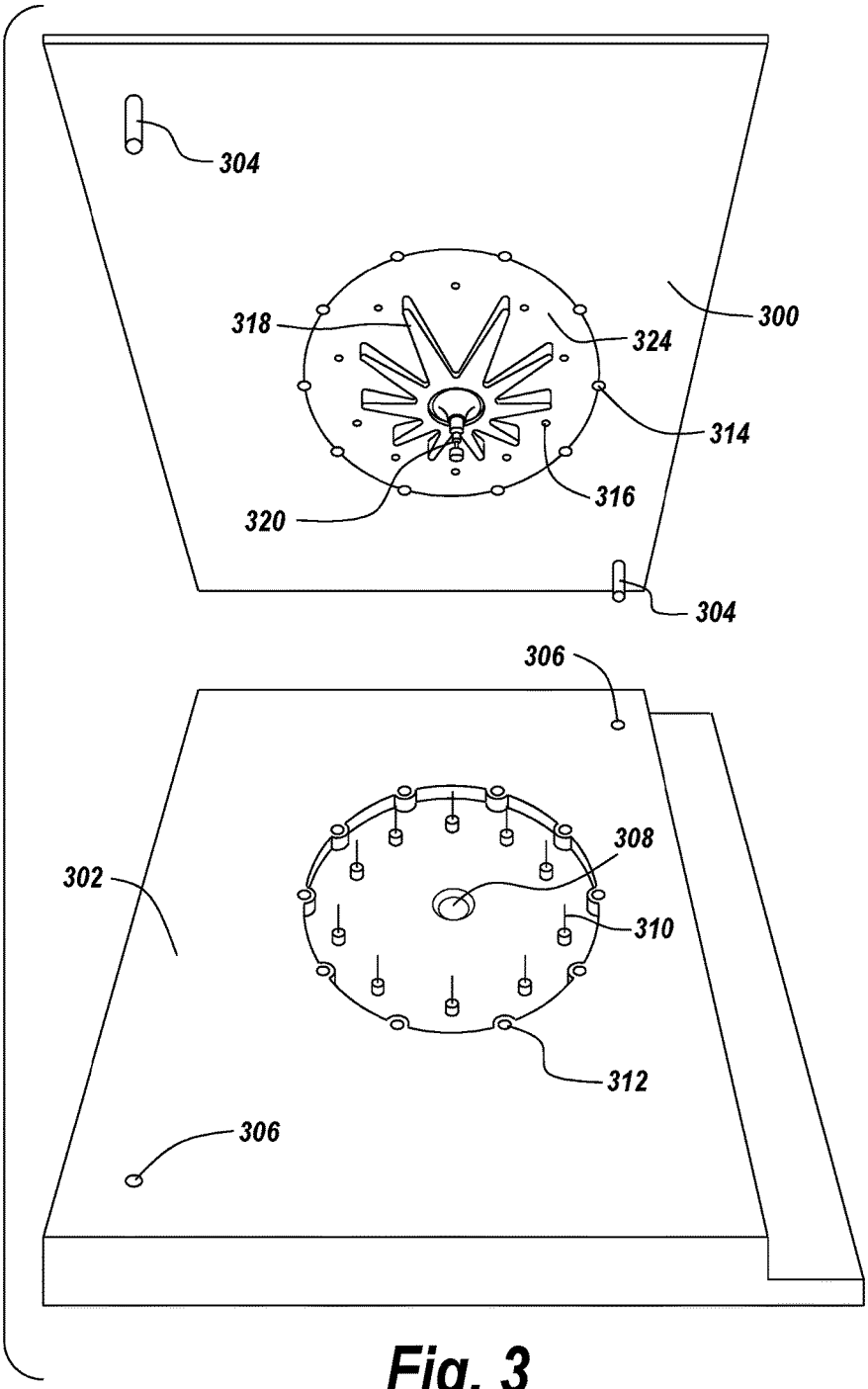
FIG. 3 shows a, partially exploded view of the top portion and bottom portion of the power combiner/divider.

FIG. 2 shows a top portion 200 of the power combiner. The top portion 200 includes a central portion 202 that is disk-shaped in this illustrative case but can assume other shapes. The central portion 202 has a star-shaped recess 204 in which a dielectric insert 206 may rest. The central portion 202 may have a raised centrally located probe assembly 208 into which a junction pin 210 may be screwed or may be attached by other means, such as epoxy. The central portion 202 may include holes 212 through which fasteners, such as screws, may pass to attach the top portion 200 to a lower portion 302 (FIG. 3). Holes 214 are provided for inputs pins 310 (FIG. 3) to pass to create the input connectors 102 (shown in FIG. 1). Posts 216 are provided to align and connect the top portion 200 with the lower portion 302. Fasteners may pass through the interiors of the posts 210.

The dielectric insert 206 is made of a dielectric material, such as a plastic, like polytetrafluoroethylene. As will be explained in more detail below, the dielectric insert 206 helps to provide impedance transformations for a smooth transformation between the input ports 102 and the output ports 110.

The dielectric insert 206 shown in FIG. 2 is star shaped. The dielectric insert 206 may include a number of spoke like extensions 207 that taper in their width as they extend outward from the central portion 205. The dielectric extensions 207 surround the waveguides and help to transform the impedance as will be described in more detail below. The number of extensions 207 may equal the number of input ports and also equal the number of waveguides extending from the input ports. The dielectric insert 206 has a circular interior opening that abuts and concentrically surrounds the center portion assembly 208 (FIG. 2) of the power combiner.

Those skilled in the art will appreciate that the dielectric insert 206 need not be made of a single dielectric material but may be formed by multiple dielectric materials. Moreover, the dielectric constant of the materials may vary. For example, different extensions 202 may have different dielectric constants. Moreover, the shape of the dielectric insert 206 may vary and need not assume a star shape as shown in FIG. 2. Still further, the dielectric constant of the dielectric insert 206 need not be uniform throughout but rather may vary over the insert. That said, for purposes of discussion of the exemplary embodiment herein, it is assumed that the dielectric insert 206 is composed of a single material having a single dielectric constant.

FIG. 3 shows the top portion 300 and the lower portion 302 of the device 100 in a partially exploded view. The bottom portion 302 includes holes 306 in which the posts 304 of the top portion 300 rest when the two portions 300 and 302 are assembled. The bottom portion 302 includes an opening 308 through which the junction pin 320 passes. The opening 308 may be tapered to accommodate the base of the center probe assembly. Holes 314 in the top portion 300 align with the holes 312 in the bottom portion 302 so that the fasteners may secure the top portion 300 with the lower portion. Pins 310 for the input probe pass through holes 316 in the top portion.

The bottom portion 322 includes a recessed disk shaped portion 322 that aligns with the disk shaped portion 324 of the top portion. When the top portion 300 and the bottom portion 302 are assembled, a disk shaped radial cavity is created.

The dielectric insert 318 rests within the radial cavity that is otherwise hollow in the power combiner 100. In some embodiments, the dielectric insert 318 may occupy substantially the entire height of the radial cavity. In other embodiments, the dielectric insert 318 need not occupy the entire height of the radio cavity.

Each input port 102 (FIG. 1) has a center conductor pin 310 that is short circuited to the housing and that is designed to transfer electromagnetic energy to the disk portion of the structure. A hollow waveguide extends from the input port 102 to carry the energy to the disk portion. The combined energy from the input ports is collected at the center of the disk position (i.e. probe assembly) and exits over a coaxial transmission line for the output port 110. Each waveguide extending from the input port is conical. The conical nature of this waveguide has the advantage that it supports a transferred electromagnetic (TEM) mode and therefore has a constant characteristic transmission line impedance against radial distance. In TEM mode, there is no electric or magnetic fields in the directions of propagation. The conical waveguide provides a gradual impedance taper.

As can be seen in FIG. 3, the star shaped dielectric insert 318 is positioned concentric to the junction pin 320 such that the number of extensions help to create electrically uniform phase paths between the input ports (see pins 310) and the junction pin 320.

Figure 4:
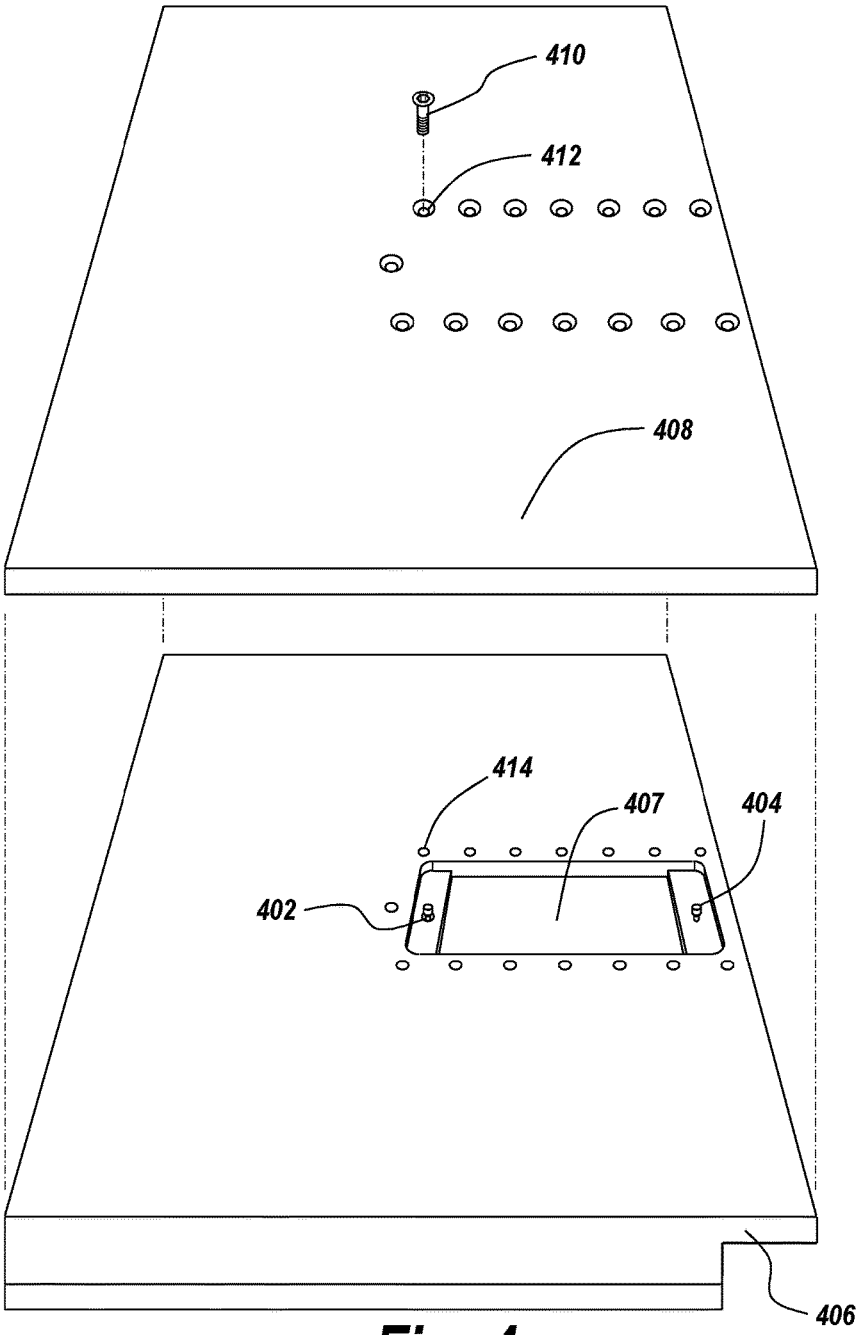
FIG. 4 shows a plate that covers a waveguide on the bottom portion of the power combiner/divider.

FIG. 4 shows the backside of the power combiner. Bottom part 406 includes a waveguide 407. The centrally positioned junction pin 402 extends into the waveguide 407 and is in electrical communication with the waveguide 407. At the other end of the waveguide 407 is an electrical pin 404 for the output port. (See 110 in FIG. 1). Microwave energy is communicated from the junction pin 402 to the waveguide 407 and is transmitted along the waveguide to pin 404. The pin 404 is part of the output port 110 (shown in FIG. 1). An additional plate 408 covers the waveguide 407. The additional plate 408 is secured by fasteners, such as screws 110, that pass through holes 412 into holes 414 in the bottom portion.

Figure 5:
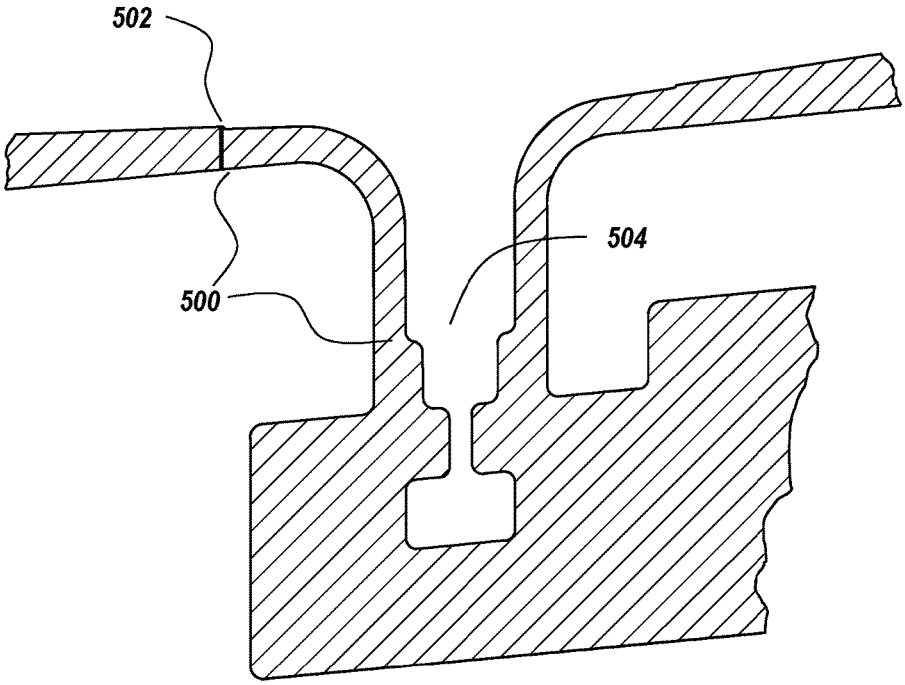
FIG. 5 shows a cross-sectioned portion of the power combiner/divider near the central junction pin.

FIG. 5 shows a quarter wavelength section 500 of the transmission path that extends from the disk portion to where the coaxial line for the output port reduces in diameter. This quarter length section 500 thus extends from the inner radius of the dielectric 206 (FIG. 2) to the location in the coaxial line for the junction pin 210 (FIG. 2) where it steps down in diameter. This section 560 is designed to act as a quarter wavelength transformer to adjust the impedance to better match the output.

Figure 6:
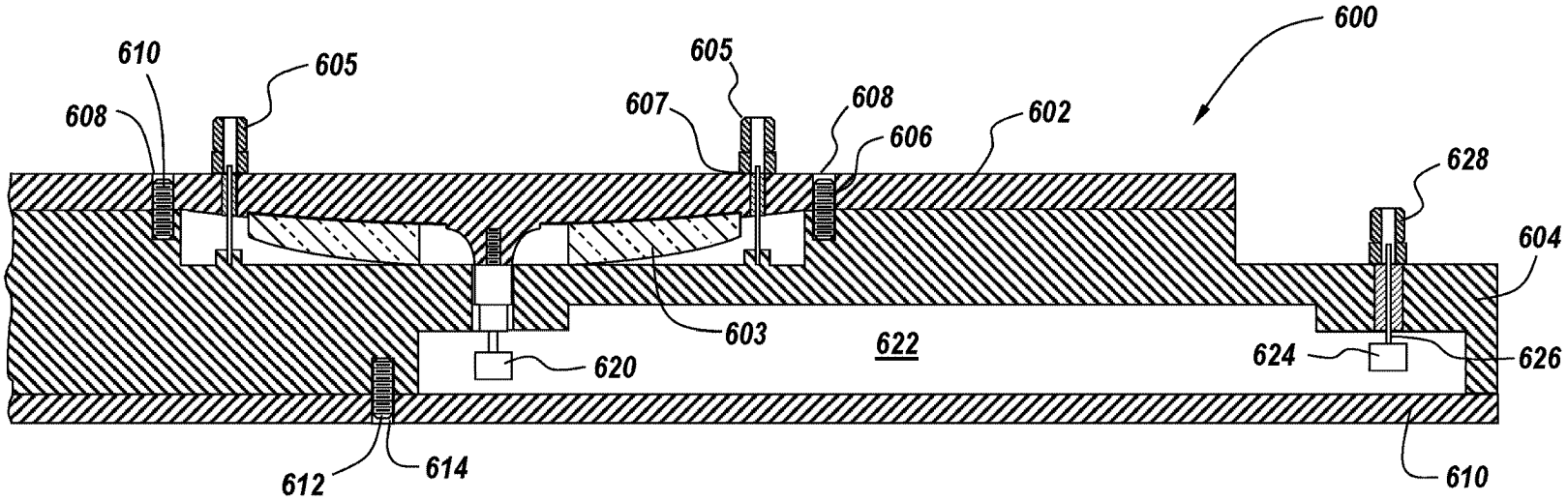
FIG. 6 shows a cross-sectional view of the power combiner/divider.

FIG. 6 provides a cross-sectional view of the power combiner 600. As can be seen in FIG. 6, top portion 602 is secured to bottom portion 604 by screws 606 that pass through aligned holes 608. Similarly, additional plate hole 610 is secured via screws 612 that pass through aligned holes 614. The waveguide 622 receives the combined microwave energy via central probe 620 and facilitates the passage of the microwave energy to probe 624. Pin 626 passes the microwave energy to the output port which includes coaxial connector 628. Input ports 607 pass the microwave signals to the waveguides in the top portion 602 so that the energy can be gathered at the central probe 620. Dielectric 603 is positioned in the hollow cavity and helps to position the waveguides.

Figure 7:
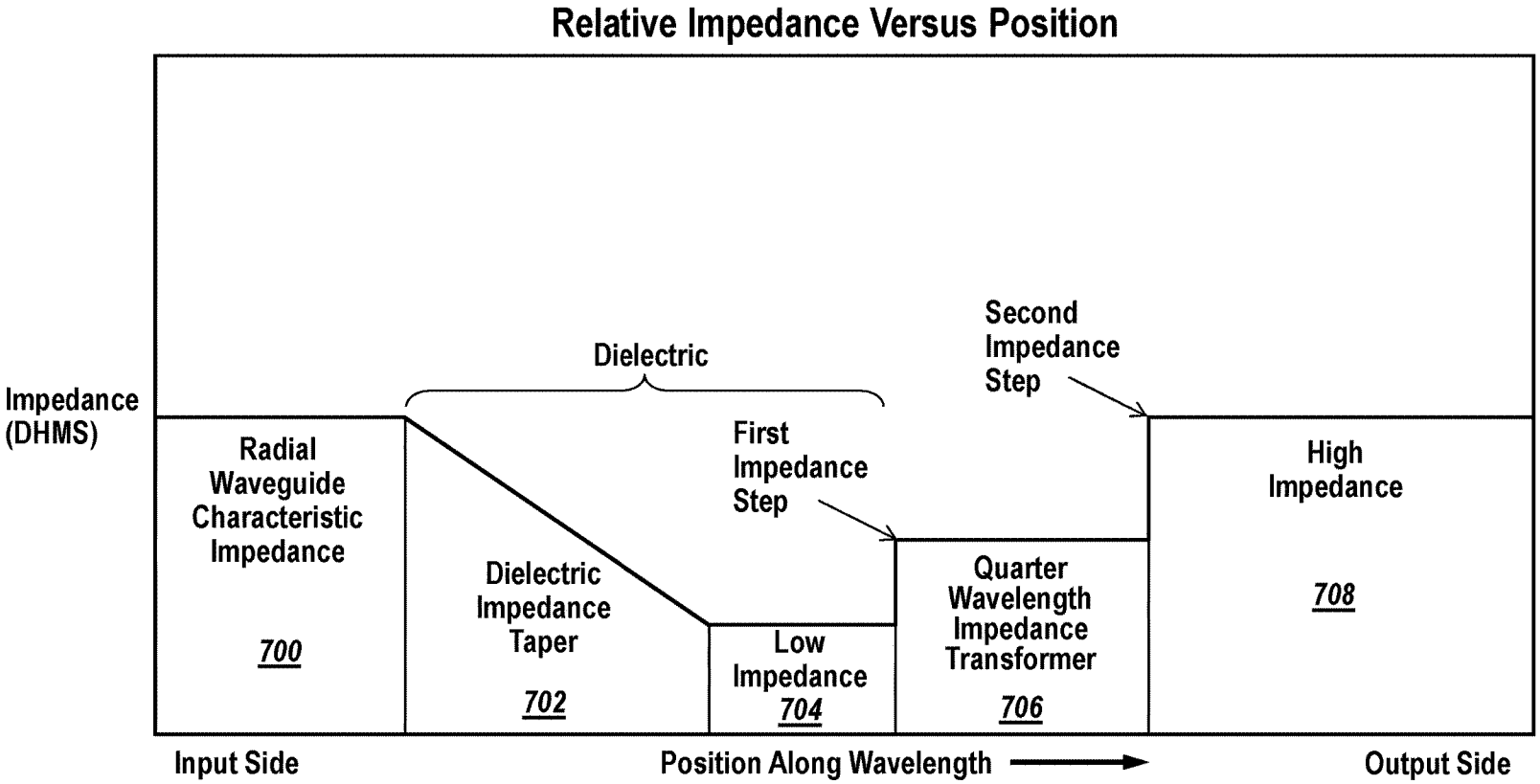
FIG. 7 is a graph depicting the changes impedance relative to position along the waveguide from an input port to the output port of an illustrative power combiner.

FIG. 7 shows a graph that maps impedance relative to position along the transmission path. As was mentioned previously, the aim of this architecture is to provide impedance matching at the input and impedance matching at the output to reduce reflections and to maximize power transfer. As can be seen in FIG. 7, initially the waveguide has a characteristic impedance. This section of the graph is designated by reference number 700. This represents the portion of the waveguide that is not enveloped by the dielectric. Then the presence of the dielectric produces a gradual reduction and impedance due to the taper of the dielectric and the taper of the waveguide. This section of the graph is designated by reference number 702. The impedance then stays at a constant level for the portions where the extension have stopped but there is still dielectric present. This is designated by reference 704 in FIG. 7. At the end of the dielectric, at impedance step occurs along the quarter wavelength section 500 (See FIG. 5). This is designated by reference 706 in FIG. 7. Lastly, with the taper, due to the step down and the coaxial line, an increase of high impedance is reached that is designed to match the coaxial line output impedance. This is shown in reference number 708 in FIG. 7.

Thus, as FIG. 7 illustrates, the impedance is matched to the input and output and gradually tapered as needed to produce optical performance.

The effect of the dielectric insert on the impedance of the waveguide may be expressed as follows. The impedance of the dielectric loaded part is $$Z_D = \frac{1}{\sqrt{k}} Z_{air}$$

where k is the dielectric constant of the dielectric used in the dielectric insert and $Z_{air}$ is the impedance of the radial waveguide in air.

As was discussed above, a quarter wavelength impedance transformers is utilized. The impedance of the output may be expressed as $Z_{air}^2 = Z_D Z_{output}$. As such, we get that $Z_{output} = \sqrt{k} Z_{air}$ by combining the two equations set forth above. This equation illustrates that the dielectric constant of the dielectric insert affects the output impedance and therefore the output match.

The device 100 of FIG. 1 may instead be a power divider. When the device is configured as a power divider, the radially positioned ports 102 act as output ports, and the centrally positioned port 110 acts as an input port. The dielectric insert and the disk shaped cavity may be the same as described above relative to the power combiner. The waveguides and other structures described below may also be the same.

While the present invention has been described with reference to exemplary embodiments herein, those skilled in the art will appreciate that various changes in form and detail may be made without departing from the intended scope of the present invention as defined in the appended claims.

What is claimed as new and desired to be protected by Letters Patent of the United States is:

1. A radial power combiner, comprising an electrically conductive housing having a disk shaped cavity;

a plurality of input ports for receiving inputs, wherein the input ports are positioned radially around the disk shaped cavity and have electrical connections to the housing;

a junction rod centrally positioned at the disk shaped cavity for combining the inputs received by the input ports;

an output port having electrical communication with the junction rod;

wherein the housing provides tapered waveguides extending from the input ports to the junction rod;

wherein the a disk shaped cavity comprises a dielectric material positioned concentrically around the output port;

wherein the dielectric material has extenders extending radially outward from a central position, and wherein the extenders are stepped radially.

2. A radial power combiner, comprising an electrically conductive housing having a disk shaped cavity;

a plurality of input ports for receiving inputs, wherein the input ports are positioned radially around the disk shaped cavity and have electrical connections to the housing;

a junction rod centrally positioned at the disk shaped cavity for combining the inputs received by the input ports;

an output port having electrical communication with the junction rod;

wherein the housing provides tapered waveguides extending from the input ports to the junction rod;

wherein the a disk shaped cavity comprises a first dielectric material positioned concentrically around the output port;

wherein the first dielectric material has extenders extending radially outward from a central position, and wherein multiple dielectric materials are positioned in the radial cavity.

3. A radial power combiner, comprising an electrically conductive housing having a disk shaped cavity;

a plurality of input ports for receiving inputs, wherein the input ports are positioned radially around the disk shaped cavity and have electrical connections to the housing;

a junction rod centrally positioned at the disk shaped cavity for combining the inputs received by the input ports;

an output port having electrical communication with the junction rod;

wherein the housing provides tapered waveguides extending from the input ports to the junction rod;

wherein the a disk shaped cavity comprises a dielectric material positioned concentrically around the output port;

wherein the dielectric material has extenders extending radially outward from a central position, and wherein the dielectric material occupies substantially all of a height of the radial cavity where present in the radially cavity.

4. The radial power combiner of claim 3 wherein the extenders are tapered radially.

5. The radial power combiner of claim 3 wherein the dielectric material is plastic.

6. The radial power combiner of claim 3 wherein the housing is made of metal.

7. The radial power combiner of claim 3 wherein the junction rod comprises cylindrical sections of various diameters.

8. The radial power combiner of claim 3 further comprising one or more impedance transformers radially positioned between the dielectric material and the junction rod.

9. A radial power combiner, comprising an electrically conductive housing having a disk shaped cavity;

a plurality of input ports for receiving inputs, wherein the input ports are positioned radially around the disk shaped cavity and have electrical connections to the housing;

a junction rod centrally positioned at the disk shaped cavity for combining the inputs received by the input ports;

an output port having electrical communication with the junction rod;

wherein the housing provides tapered waveguides extending from the input ports to the junction rod;

wherein the a disk shaped cavity comprises a dielectric material positioned concentrically around the output port;

wherein the dielectric material has extenders extending radially outward from a central position, and wherein there is a structure to prevent the dielectric insert from sliding.

10. The radial power combiner of claim 9 wherein the structure is a recess.

11. The radial power combiner of claim 3 wherein the input ports are coaxial input ports.

12. The radial power combiner of claim 3 wherein the input ports are waveguide input ports.

13. The radial combiner of claim 3 wherein the output port is coaxial output port.

14. The radial power combiner of claim 3 wherein the output port is a waveguide output port.

15. A radial power divider, comprising an electrically conductive housing having a disk shaped cavity;

an input port for receiving an input;

a junction pin centrally positioned in the disk shaped cavity for distributing the input to the output ports and being electrically connected to the housing;

output ports for outputting outputs, wherein the output ports are positioned radially around the disk shaped cavity and have electrical connections to the housing;

wherein the housing includes tapered waveguides extending from the junction pin to the output ports; and dielectric material positioned concentrically around the junction pin, the dielectric material has tapered extensions extending radially outward from a central position and occupies substantially all of a height of the radial cavity where present in the radial cavity.

* * * * *